United States Patent [19]

Kuramoto et al.

[11] Patent Number: 4,939,078

[45] Date of Patent: Jul. 3, 1990

[54] DIRECT POSITIVE-TYPE SILVER HALIDE LIGHT-SENSITIVE PHOTOGRAPHIC MATERIAL

[75] Inventors: Kazuya Kuramoto; Bunzo Ueda; Yasuo Tosaka, all of Odawara, Japan

[73] Assignee: Konica Corporation, Tokyo, Japan

[21] Appl. No.: 247,172

[22] Filed: Sep. 21, 1988

[30] Foreign Application Priority Data

Sep. 22, 1987 [JP] Japan ..... 62-238229
Oct. 3, 1987 [JP] Japan ..... 62-250258

[51] Int. Cl.[5] ..... G03C 1/46

[52] U.S. Cl. ..... 430/505; 430/503; 430/506; 430/567; 430/574

[58] Field of Search ..... 430/503, 505, 506, 567, 430/574

[56] References Cited

U.S. PATENT DOCUMENTS 4,306,017 12/1981 Baralle et al. ..... 430/589
4,749,644 6/1988 Tosaka et al. ..... 430/567
4,801,520 1/1989 Inoue et al. ..... 430/505

*Primary Examiner*—Paul R. Michl
*Assistant Examiner*—Hoa Van Le
*Attorney, Agent, or Firm*—Jordan B. Bierman

[57] ABSTRACT

A direct positive type silver halide photographic material and developing method therefor are disclosed. The photographic material have blue-, green- and red-sensitive emulsion layers and each of these emulsion layer contains at least two kinds of silver halide emulsion being different from each other in average grain size. The average grain diameter S of the emulsion having the smallest average grain size and the average grain diameter of the emulsion having the largest average grain size in each emulsion layer have a proportional relation of $1.6 \leqq L/S$. The emulsion having the smallest average grain size is contained in a ratio of from 2 to 50% in the blue-sensitive layer and 2 to 40% in green- and red-sensitive emulsion layer.

22 Claims, 2 Drawing Sheets

DIRECT POSITIVE-TYPE SILVER HALIDE LIGHT-SENSITIVE PHOTOGRAPHIC MATERIAL

FIELD OF THE INVENTION

The present invention relates to a direct positive-type silver halide light-sensitive photographic material, and particularly to a direct positive-type silver halide light-sensitive photographic material which is capable of forming high-quality images having a sufficiently high maximum density, a sufficiently low minimum density and a broad gradation, and which can be processed stably against fluctuations in processing conditions.

BACKGROUND OF THE INVENTION

An emulsion to be applied to the direct positive-type silver halide light-sensitive photographic material needs to be capable of forming good quality images having a sufficiently high maximum density and a sufficiently low minimum density, and also needs to have a sufficiently wide fogging latitude in the light-fogging or chemically fogging process. And in addition, there are fields which require the emulsion to have a soft gradation and a wide exposure latitude.

As the method for widening the fogging latitude by increasing the maximum density and lowering the minimum density, there have been conventionally known the minimum density, there have been conventionally known those methods for its improvement by using antifoggants, development restrainers or selectively spectrally sensitizing dyes. Such methods, however, are disadvantageous in respect that they are unable to give any sufficiently low minimum density, and if the development restrainer is used in a large amount in trying to lower the minimum density, the maximum density (image density) becomes lowered.

As the method for obtaining a wide exposure latitude and a soft gradation by lowering the gamma value, there have been known those methods which use a mixture of direct positive silver halide emulsions different in the sensitivity, for example, a mixture of such emulsions whose sensitivities are varied by using desensitizers. However, they are undesirable in respect of the utilization efficiency of silver and deterioration in the graininess of silver images. For obtaining a softer gradation, the use of a mixture of silver halide emulsions which largely differ in the grain size is also known. However, direct positive silver halide emulsions different in the sensitivity, since their respective fogging latitutdes are different, have the disadvantage that the fogging latitude in the mixture system of the emulsions (overlapped part of their respective latitudes) becomes narrower, so that the resulting image density obtained by development is liable to be fluctuated.

Where silver halides largely different in the grain size exist together, when developed, there occurs a large difference in the developing speed between the larger grain size-having silver halide and the smaller grain size-having silver halide, thus resulting in making them unable to be developed stably against fluctuations in developing conditions.

Further, if the proportion in the grain size (the proportion of the average grain diameter of the smallest average grain size-having silver halide emulsion to the average grain diameter of the largest average grain size-having silver halide emulsion in a light-sensitive material) is excessively large, difference in the developing speed between the respective silver halide emulsions occurs, thus causing the light-sensitive material to be unstable in development, while on the contrary if the proportion in the grain size is to small, the fogging latitude becomes wider to improve the processing stability, but the obtaining of a soft gradation cannot be expected.

In a silver halide light-sensitive photographic material containing at least three layers—a blue-sensitive layer, a green-sensitive layer and a red-sensitive layer, it is essential for the three layers to be well balanced; it is undesirable that even any only one of the layers have a narrow fogging latitude or be unstable in development.

SUMMARY OF THE INVENTION

The present invention has been made in order to solve the above-mentioned problems.

It is therefore an object of the present invention to provide a direct positive-type silver halide light-sensitive photographic material which is capable of forming a high quality images having a sufficiently high maximum density and a sufficiently low minimum density, of which the gamma value is low enough to exhibit a soft gradation with a wide exposure latitude (allowable exposure range at the time of imagewise exposure), and of which the fogging latitude (allowable exposure range for high-fogging or allowable processing range for chemcially fogging at the time of the fogging development) is so wide that it can be processed stably against fluctuations in processing conditions, and moreover, of which the fogging latitude and the gamma value are well balanced.

The above object of this invention is accomplished by a direct positive-type silver halid light-sensitive material comprising a support having thereon at least one blue-sensitive silver halide emulsion layer, at least one green-sensitive silver halide emulsion layer and at least one red-sensitive silver halide emulsion layer, which, after being imagewise exposed, are to directly form a positive image by being light-fogged while in developing or by developing in the presence of a fogging agent, wherein each of the silver halide emulsion layers is comprised of at least two silver halide emulsions being different in the average grain size, and in each of the emulsion layers, the average grain diameter S of silver halide grains of the emulsion having the smallest average grain size and the average grain diameter L of silver halide grains of the emulsion having the largest average grain size have a proportional relation of $1.6 \leqq L/S$, and the ratio by weight of silver halide grains of the emulsion having the smallest average grain size in each silver halide emulsion layer to the whole silver halide grains contained in each silver halide emulsion layer is within the range of from 2% to 50% in the blue-sensitive emulsion layer, from 2% to 40% in the green-sensitive and red-sensitive emulsion layers; and the blue-sensitive emulsion layer contains at least one sensitizing dye represented by the following Formula I, the green-sensitive emulsion layer contains at least one sensitizing dye represented by the following Formula II and the red-sensitive emulsion layer contains at least one sensitizing dye represented by the following Formula III,

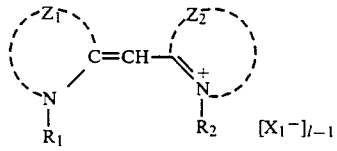

Formula I wherein $Z_1$ and $Z_2$ each represents a group of atoms necessary to complete a ring of benzothiazole, naphthothiazole, benzoselenazole or naphthoselenazole; $R_1$ and $R_2$ each represents an unsubstituted or substituted alkyl group, provided that at least one of the $R_1$ $R_2$ represents an alkyl group substituted by a sulfo group or carboxyl group; $X_1^-$ represents an anion; and 1 represents an integer of 1 or 2,

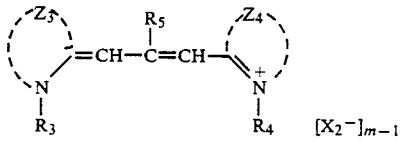

Formula II wherein $Z_3$ and $Z_4$ each represents a group of atoms necessary to complete a ring of benzoxazol or naphthoxazole; $R_3$ and $R_4$ each represents an unsubstituted or substituted alkyl group, provided that at least one of the $R_3$ and $R_4$ represents an alkyl group substituted by a sulfo group or a carboxyl group; $R_5$ represents alower alkyl group; $X_2^-$ represents an anion; and m represents an integer of 1 or 2,

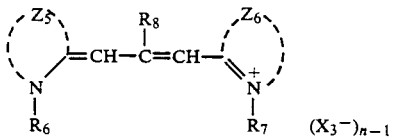

Formula III wherein Z $_5$ and $Z_6$ each represents a group of atoms necessary to complete a ring of benzothiazole, naphthothiazole, benzoselenazole or naphthoselenazole; $R_6$ and $R_7$ each represents an unsubstituted or substituted alkyl group, provided that at least one of the $R_6$ and $R_7$ represents an alkyl group substituted by a sulfo group or a carboxyl group; $R_8$ represents an alkyl group or an aryl group; $X_3^-$ represents an anion; and n represents an integer or 1 or 2.

DETAILED DESCRIPTION OF THE INVENTION

Figure 1:
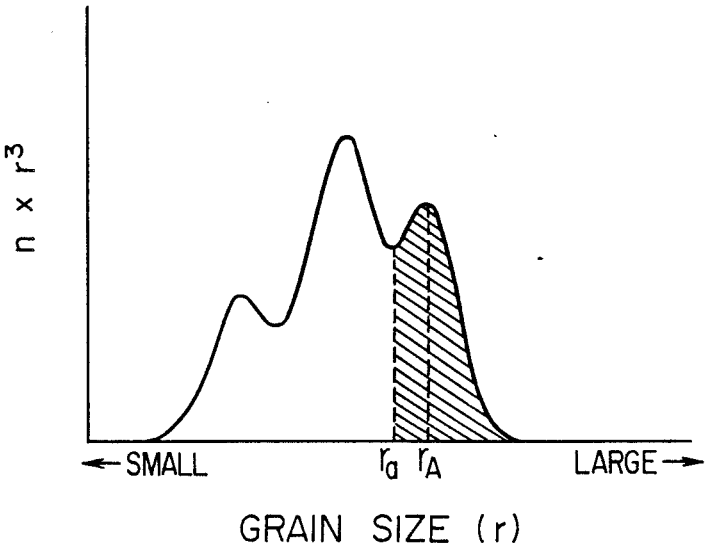
FIGS. 1, 2 and 3 are graphs for explaining the size distribution of silver halide grains of the emulsion of the invention.

The light-sensitive material according to the present invention has on its support at least one blue-sensitive layer, at least one green-sensitive layer and at least one red-sensitive layer. Each of these respective 'at least one' blue-sensitive, green-sensitive and red-sensitive layers may be either a single layer or multilayer. The blue-sensitive, green-sensitive and red-sensitive layers each comprises at least two silver halide emulsions different in the average grain size. Where each of the light-sensitive layers is a single layer, the layer is to contain at least two silver halide emulsions different in the average grain size, while where a certain color-sensitive layer is comprised of a plurality of layers, they may be of such a construction that one layer contains one emuslion and the other layer of layers contain(s) an emulsion that is different in the average grain size than the foregoing emulsion contained in the above-mentioned layer, or each of the layers contains a mixture of different average grain sizes-having emulsions.

In this invention, the blue-sensitive, green-sensitive and red-sensitive silver halide emulsion layers each contains at least two silver halide emulsions different in the average grain size, and in each light-sensitive halide emulsion layer, the average grain diameter S of the smallest average grain size-haivng silver halide emulsion and the average grain diameter L of the largest average grain size-having silver halide emulsion have the following proportional relation: $1.6 \leqq L/S$. A preferred embodiment is the case where the blue-sensitive layer, green-sensitive layer and red-sensitive layer are single layers. The respective light-sensitive layers may also be superposed layers. The grain size ratio L/S is particularly preferably from 1.6 to 2.3.

In each of the light-sensitive layers according to this invention, as for the mixing ratio by weight P of the smallest average grain size-having silver halide emulsion to the amount by weight of the whole silver halide of each layer, the ratio by weight $P_B$ in the blue-sensitive layer is from 2% to 50%, the ratio by weight $P_G$ in the green-sensitive layer is from 4% to 40%, and the ratio by weight $P_R$ is from 2 to 40%, and preferably $P_B$ is from 2% to 40%, $P_G$ is from 2% to 25%, and $P_R$ is from 2% to 20%, and more preferably $P_B$ is from 10% to 40% in the blue-sensitive layer, $P_G$ is from 8% to 25% in the green-sensitive layer, and $P_R$ is from 5% to 20% in the red-sensitive layer.

The blue-sensitive layer contains at least one of those spectrally sensitizing dyes having Formula I. The blue-sensitive layer is desirable to contain at least one kind of silver halide grains into which is incorporated at least one spectrally sensitizing dye having Formula I in an amount of not less than $5.5\times10^{-7}$ mole/m$^2$ of surface area of silver halide grains, more preferably from $5.5\times10^{-7}$ mole to $15.0\times10^{-7}$ mole/m$^2$, and most preferably from $6.5\times10^{-7}$ mole/m$^2$ to $11.0\times10^{-7}$ mole/m$^2$. The blue sensitive layer may also contain two or more different spectrally senstizing dyes having Formula I.

The green-sensitive layer contains at least one of those spectrally senitizing dyes having Formula II. The green-sensitive layer is desirable to contain at least one kind of silver halide grains into which is incorporated at least one spectrally sensitizing dye having Formula II in an amount of not less than $2.0\times10^{-7}$ mole/m$^2$ of surface area of silver halide grains, more preferably from $2.0\times10^{-7}$ mole/m$^2$ to $8.0\times10^{-7}$ mole/m$^2$, and most preferably from $2.5\times10^{-7}$ mole/m$^2$ to $5.0\times10^{-7}$ mole/m$^2$. The green-sensitive layer may also contain two or more different spectrally sensitizing dyes having Formula II.

The red-sensitive layer contains at least one of those spectrally sensitizing dyes having Formula III. The red-sensitive layer is desirable to contain at least one kind of silver halide grains into which is incorporated at least one spectrally sensitizing dye having Formula III in an amount of not less than $1.5\times10^{-7}$ mole/m$^2$ of surface area of silver halide grains, more preferably from $1.5\times10^{-7}$ mole/m$^2$ to $7.5\times10^{-7}$ mole/m$^2$, and most preferably from $2.0\times10^{-7}$ mole/m$^2$ to $4.5\times10^{-7}$ mole/m$^2$. The red-sensitive layer may also contain two or more different spectrally sensitizing dyes having Formula III.

The sensitizing dyes represented by Formulas I, II and III, which are for use in the silver halide light-sensitive photographic material of this invention, will then be described in detail below:

Formula I

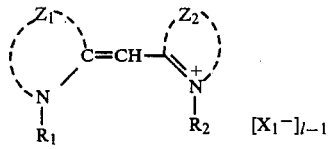

wherein the rings represented by $Z_1$ and $Z_2$ may be either the same or different, and examples of the ring include benzothiazole ring, naphtho[1,2-d]thiazole ring, naphtho[2,1-d]-thiazole ring, naphtho[2,3-d]thiazole ring, benzoselenazole ring, naphtho[1,2-d]selenazole ring, naphtho[2,1-d]selenazole ring, naphtho[2,3-d]selenazole ring and the like. The preferred one out of these rings is a benzothiazole ring.

The above ring may have one or two or more various substituents.

Suitable examples of such substituents include hydroxy group, halogen atoms such as fluorine, chlorine, bromine, nonsubstituted and substituted alkyl groups such as methyl, ethyl, propyl, isopropyl, hydroxyethyl, carboxymethyl, ethoxycarbonylmethyl, trifluoromethyl, chloroethyl, methoxymethyl, etc., aryl groups and substituted aryl groups such as phenyl, tolyl, anisyl, chlorophenyl, 1-naphthyl, 2-naphthyl, carboxyphenyl, etc., heterocyclic groups such as 2-thienyl, 2-furyl, 2-pyridyl, etc., aralkyl groups such as benzyl, phenethyl, 2-furylmethyl, etc., alkoxy groups such as methoxy, ethoxy, butoxy, etc.), alkylthio groups such as methylthio, ethylthio, etc., caboxy group, alkoxycarbonyl groups such as methoxycarbonyl, ethoxycarbonyl, butoxycarbonyl, etc., acylamino groups such as acetylamino, propionylamino, benzoylamino, ect., two adjacent groups-linked methylenedioxy group, tetramethylene group, and the like.

Examples of the substituted or unsubstituted alkyl group represented by the $R_1$ or $R_2$ include methyl, ethyl, propyl, butyl, isopropyl, pentyl, hexyl, 2-hydroxyethyl, 3-hydroxypropyl, 2-(2-hydroxyethoxy)ethyl, ethoxycarbonylemthyl, 2-phosphonoethyl, 2-chloroethyl- 2,2,2-trifluoroethyl, 2,2,3,3-tetrafluoropropyl, 2-carbamoylethyl, 3-carbamoylpropyl, methoxyethyl, ethoxyethyl, methoxypropyl, benzyl, phenethyl, p-sulfophenethyl, m-sulfophenethyl, p-carboxyphenethyl, and the like groups. At least one of the $R_1$ and $R_2$ is an alkyl group substituted by a sulfo or carboxyl group. Examples of the carboxyl-substituted alkyl group include, e.g., carboxymethyl, 2-carboxyethyl, 3-carboxypropyl, and the like groups. Examples of the sulfo-substituted alkyl group include, e.g., 2-sulfoethyl, 3-sulfopropyl, 3-sulfobutyl, 4-sulfobutyl, 2-hydroxy-3-sulfopropyl, 2-(3-sulfopropyloxy)ethyl, 2-sulfatoethyl, 3-sulfatopropyl, and the like groups. The number of carbon atoms of such the sulfo- or carboxyl-substituted alkyl group is preferably not more than 5.

The anion represented by $X_1^-$ is a halogen ion or inorganic or organic acid ion. The $X_1^-$, need not be present (1 = 1) in the case where the $R_1$ or $R_2$ is a sulfoalkyl group, which is to form an intramolecular salt with the nitrogen atom on the condensed heterocyclic ring.

Formula II

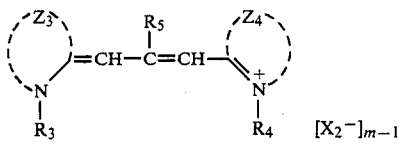

wherein the rings represented by the $Z_3$ and $Z_4$ may be either the same or different, and examples of the ring include benzoxazole ring, naphtho[2,1-d]oxazole ring, naphtho[1,2-d]-oxazole ring, naphtho[2,3-d]oxazole ring, and the like.

The above ring may have thereon one or two or more substituents, and suitable examples of the substituent include similar groups to those as defined in the foregoing Formula I.

Examples of the substituted or unsubstituted alkyl group represented by the $R_3$ or $R_4$ include similar groups to those represented by the $R_1$ or $R_2$ of Formula I.

At least one of the $R_3$ and $R_4$ is an alkyl group substituted by a sulfo or carboxyl group, and examples of the alkyl group include similar groups to those as described in the $R_1$ or $R_2$ of Formula I.

The lower alkyl group represented by the $R_5$ is preferably an alkyl group having not more than 4 carbon atoms, such as, for example, methyl, ethyl, propyl or the like group.

The anion represented by the $X_2^-$ is as defined in the $X_1^-$ of Formula I.

Formula III

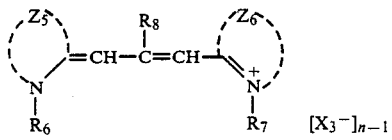

wherein the rings represented by the $Z_5$ and $Z_6$ may be either the same or different, and examples of the ring include benzothiazole ring, naphtho[1,2-d]thiazole ring, naphtho[2,1-d]-thiazole ring, naphtho[2,3-d]thiazole ring, and the like.

The above ring may have thereon one or two or more substituents, and useful examples of the substituent include similar groups to those as described in Formula I.

Examples of the substituted or unsubstituted alkyl group represented by the $R_6$ or $R_7$ include similar groups to those as defined in the $R_1$ and $R_2$ of Formula I.

At least one of the $R_6$ and $R_7$ is an alkyl group substituted by a sulfo or carboxyl group, and examples thereof also include similar groups to those as explained in the $R_1$ and $R_2$ of Formula I.

The alkyl group represented by the $R_8$ includes those having substituents, and examples of the substituent include methyl, ethyl, propyl, benzyl, phenethyl and the like groups. The aryl group represented by the $R_8$ is preferably a phenyl group.

The anion represented by the $X_3^-$ is as defined in the $X_1^-$ of Formula I.

The following are typical examples of the sensitizing dyes having the foregoing Formulas I, II and III (hereinafter referred to as sensitizing dyes of this invention), but the invention is not limited to and by the examples.
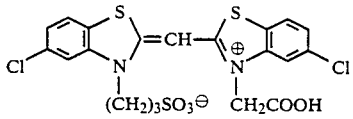
(I-1)
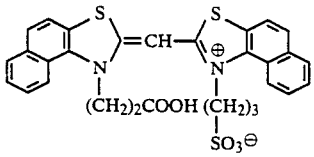
(I-2)
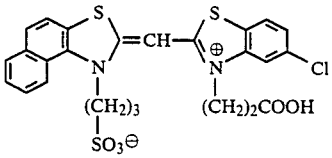
(I-3)
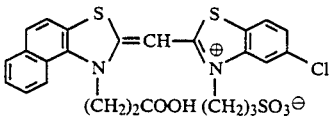
(I-4)
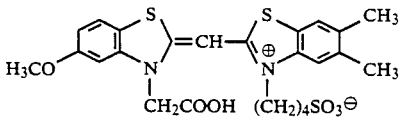
(I-5)
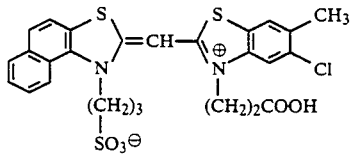
(I-6)
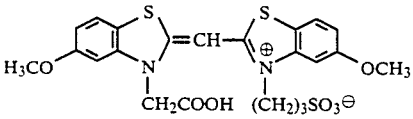
(I-7)
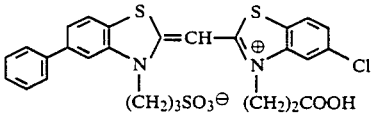
(I-8)
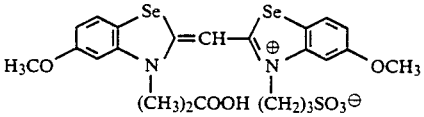
(I-9)
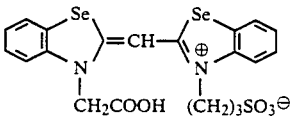
(I-10)
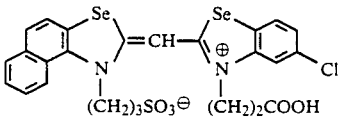
(I-11)
-continued
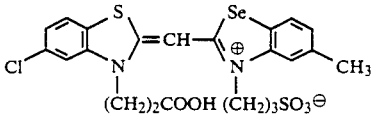
(I-12)
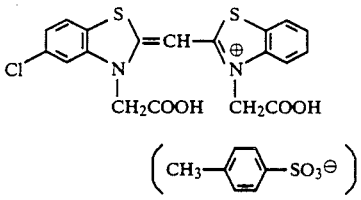
(I-13)
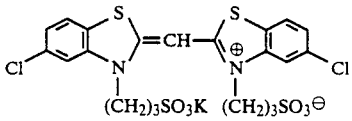
(I-14)
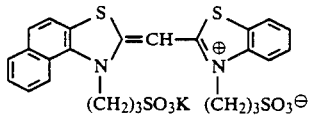
(I-15)
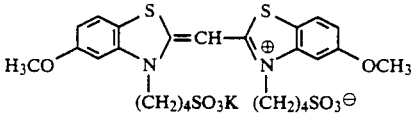
(I-16)
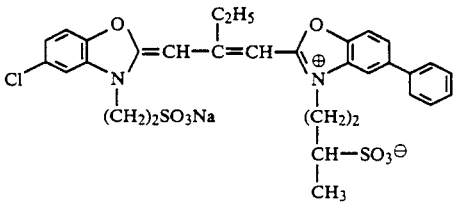
(II-1)
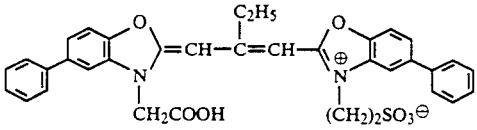
(II-2)
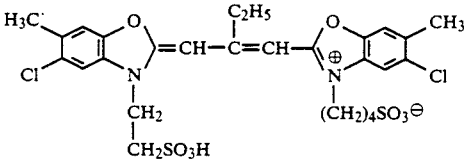
(II-3)
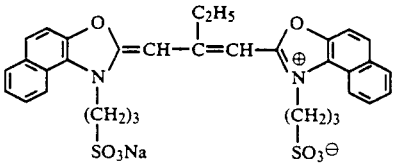
(II-4)
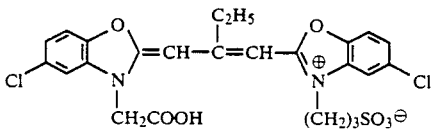
(II-5)

-continued (II-6)

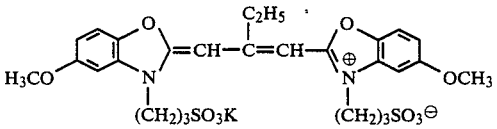

(II-7)

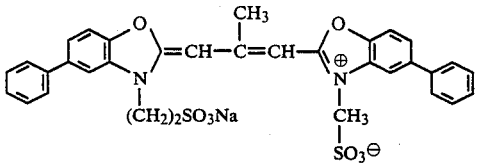

(II-8)

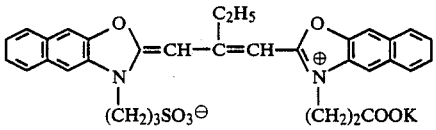

(II-9)

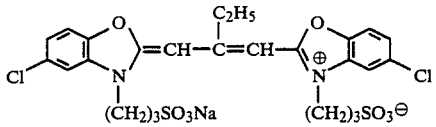

(II-10)

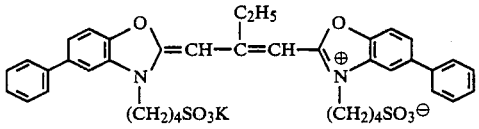

(III-1)

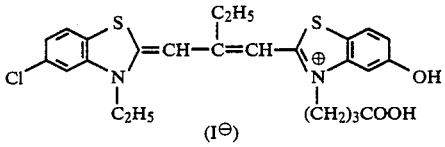

$(I^{\ominus})$ (III-2)

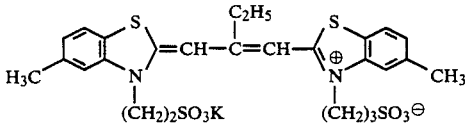

(III-3)

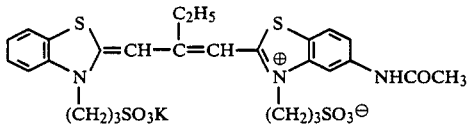

(III-4)

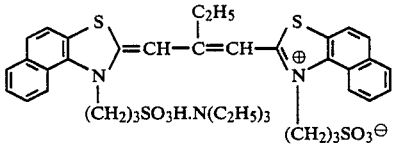

(III-5)

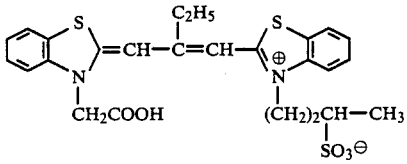

(III-6)

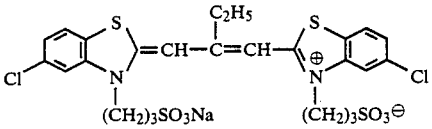

-continued (III-7)

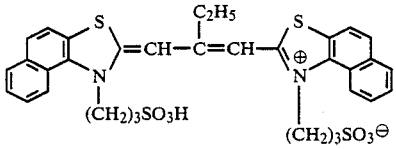

(III-8)

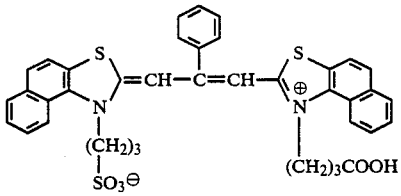

(III-9)

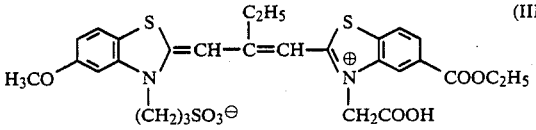

(III-10)

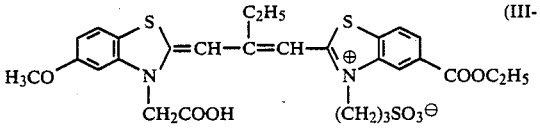

(III-11)

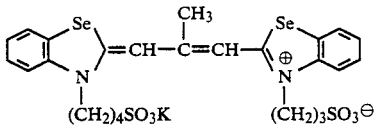

(III-12)

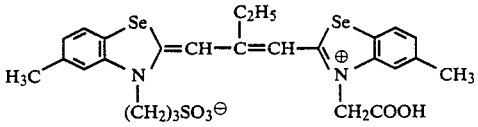

(III-13)

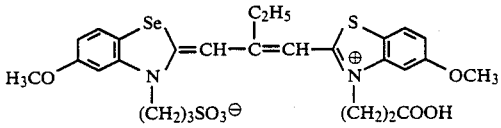

(III-14)

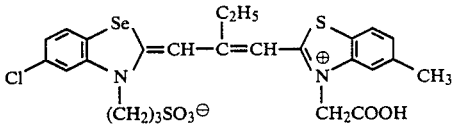

(III-15)

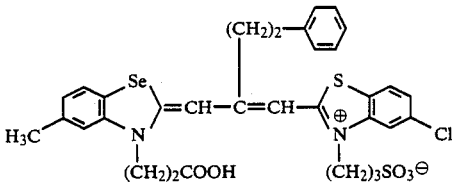

Preparation of the silver halide emulsion to be used in this invention will be described. Regarding the emulsion, in the following manner, two or more emulsions are separately prepared and mixed so as to form a desired average grain size-having emulsion, and the thus prepared emulsion is then used (or in one and the same color-sensitive layer, these emulsions, without being mixed, are allowed to be used to form their own independent sub-layers).

Silver halide grains to be used in this invention may be ones obtained by any one of the acidic method, neutral method or ammoniacal method. These grains may be grown either at a time or after preparing seed grains. The preparing method and the growing method for such seed grains may be either the same or different. A silver halide emulsion containing such silver halide grains may be prepared by simultaneously mixing halide ions and silver ions or by mixing either one part into a liquid containing the other. Alternatively, the growth may be carried out by sequentially simultaneously pouring halide ions and silver ions into the reaction pot with its inside pH and pAg being controlled, taking into account the critical growth rate of the silver halide crystals thereinside. By doing this, silver halide grains in the regular crystal form and having nearly uniform grain sizes can be obtained. After the growth, the conversion method may be used to change the halide composition of the grain.

Each of the thus obtained two or more silver halide emulsions, although allowed to have any grain size distribution, is desirable to be a monodisperse emulsion. The term 'monodisperse emulsion' herein implies an emulsion wherein the silver halide grains whose grain sizes are in the distribution range of $\pm 20\%$ to the silver halide grains' average grain diameter $\bar{r}$ account for not less than 60% by weight of the whole silver halide grains contained in the emulsion. An emulsion wherein this ratio is more than 70%, and particularly more than 80%, is more suitably usable.

The term 'average grain diameter $\bar{r}$' means a grain diameter ri where $ni \times ri^3$, the product of the frequency ni of the grain having an grain diameter ri and $ri^3$, is maximum (effective number up to three figures, the unit digit is rounded).

The 'grain diameter' herein, in the case of a spherical silver halide grain, is its diameter, and, in the case of a nonspherical grain, is the diameter of a circular image corresponding in the area to its projection image.

The grain diameter can be found, for example, in the manner that the grain image is enlarged 10,000 to 50,000 times by an electron microscope to be projected onto a screen or to make a print, and the diameter of the printed grain image on the print, and the diameter of the printed grain image on the print or the projected image area is actually measured (the number of the grains to be measured shall be more than 1000 at random).

Herein, the grain diameter of the grain for obtaining the above grain size distribution, in the case of a spherical grain, is its diameter and, in the case of a nonspherical grain, is the diameter of a circular image corresponding in the area to its projection image, and measurement of this can be carried out by observing through an electron microscope.

When two or more silver halide emulsions different in the average grain size are contained in one and the same layer, it implies that the form of a curve showing $n \times r^3$ relating to the grain diameter r has thereon two or more hills, and the grain size at the peak of each hill corresponds to the average grain diameter of each of the silver halide emulsions different in the average grain size.

Figure 2:
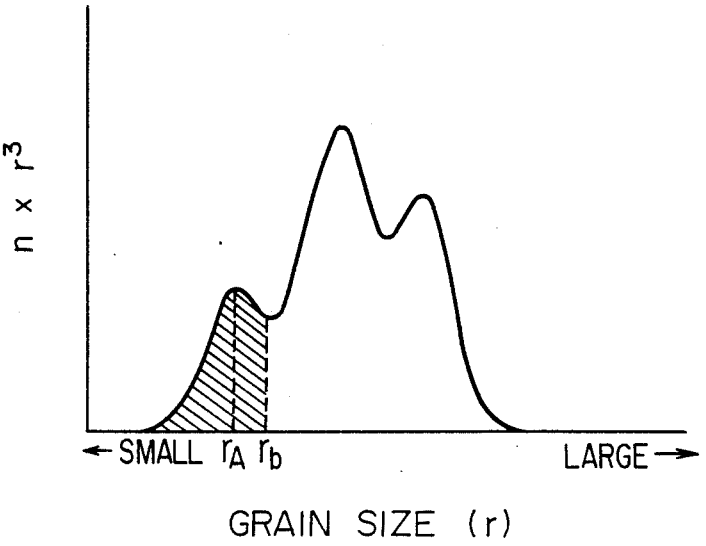
Figure 3:
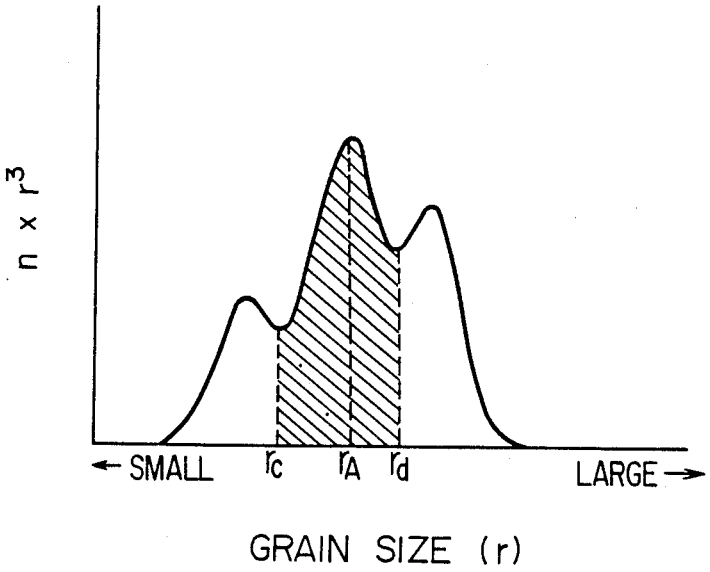

The term 'peak' herein, (1) where the grain diameter $r_A$ at the peak of an arbitrary hill is larger than the grain diameters at the peaks of all the other hills, if the grain diameter at the valley formed between it and the adjacent hill is regarded as $r_a$, means the curve formed from the grain diameter $r_a$ ($r_a$ exclusive) up to the grain diameter of the largest-size silver halide grain, provided that, the area formed herein by the curve covering the relevant grain sizes (see the oblique-lined part in FIG. 1) shall account for more than 2% of the whole area formed by the curve covering all grain sizes;

(2) where the grain diameter $r_A$ at the peak of an arbitrary hill is smaller than the grain diameters at the peaks of all the other hills, if the grain diameter at the valley formed between it and the adjacent hill regarded as $r_b$, means the curve formed from the grain diameter of the smallest-size silver halide grain up to the grain diameter $r_b$ ($r_b$ inclusive), provided that the area formed herein by the curve covering the relevant grain sizes (see the oblique-lined part in FIG. 2) shall account for more than 2% of the whole area formed by the curve that covers all grain sizes; and (3) where an arbitrary hill with the grain diameter $r_A$ has on both sides thereof two adjacent hills with two valleys formed therebetween, if the grain diameter of the grain at the larger-size-grain valley is regarded as $r_d$ and that of the grain at the smaller-size-grain valley as $r_c$, means the curve formed from the grain diameter $r_c$ up to the grain diameter $r_d$ ($r_c$ inclusive, $r_d$ exclusive), provided that the area formed herein by the curve covering the revelant grain sizes (see the oblique-lined part in FIG. 3) shall account for more than 2% of the area formed by the curve that covers all grain sizes.

Also, the term 'valley' herein means one that shall meet any of the requirements:

$$n_A \times R_A^3 > n_a \times r_a^3 \ldots \text{ in the case of} \quad (1)$$

$$n_A \times r_A^3 > n_b \times r_b^3 \ldots \text{ in the case of} \quad (2)$$

$$n_A \times r_A^3 > n_c \times r_c^3,\ n_A \times r_A^3 > n_d \times r_d^3 \ldots \text{ in the case of} \quad (3)$$

Where one and the same layer contains two or more silver halide emulsions different in the average grain size, of these, the silver halide emulsion having the smallest average grain size, if, on the curve showing $n \times r^3$ relating to the grain diameter r, the grain diameter at the valley formed between the hill corresponding to the silver halide emulsion having the smallest average grain size and its adjacent hill is regarded as $r_b$, means all the silver halide grains included within the range from the smallest-grain diameter up to the grain diameter $r_b$ ($r_b$ inclusive).

Also, the ratio by weight P of the silver halide emulsion having the smallest average grain diameter, if the total area covered by a curve showing $n \times r^3$ relating to the grain diameter r of each of all the silver halide emulsions of the same color-sensitive layer is regarded as Q and if the area covered by the curve portion corresponding to the silver halide emulsion having the smallest grain size in the same color-sensitive layer is regarded as q, can be expressed as:

$$P = \frac{\sigma_q x q}{\sigma_Q x Q} \times 100$$

wherein $\delta_Q$: the average specific gravity of the whole silver halide emulsions contained in the same color-sensitive layer, and $\delta_q$: the average specific gravity of the silver halide emulsion in the layer containing the smallest average grain size-having silver halide emulsion.

The silver halide grain of this invention may be comprised of at least two phases different from each other in the silver halide composition. The external shell phase in the outermost position may only cover at least a part of the internal core. The grain may be of a structure wherein the internal core phase forms a core and the external shell phase forms a shell to cover the core; i.e., the so-called core/shell structure, or of a structure wherein the second phase covers a part of the first phase.

The silver halide grain of this invention may also be comprised of three or more phases; for example, a three-phase-composition silver halide grain wherein the first phase which is the innermost core, the internal shell phase that covers the first core phase, and the external shell phase that covers the internal shell phase. Hereinafter, in order to make the description as simple as possible, double-phase-structure grains will be taken up and explained with the first phase in the outermost position regarded as the external shell phase and the second phase adjacent thereto regarded as the internal core phase, but the silver halide grain of the present invention is not limited to the double-phase-structure grain.

The internal core phase of the silver halide grain of this invention is desirable to contain a smaller amount of silver chloride than that contained in the external shell phase.

The internal core phase, preferably, is comprised principally of silver bromide, and further may contain silver chloride and/or silver iodobromide. The configuration of the silver halide grain to form the internal core phase may be arbitrary; for example, it may be a cubic, regular octahedral, dodecahedral or tetradecahedral form, or other form in a mixture of them, or any other form such as a spherical, planar or indeterminate form or an arbitrarily mixed form of them. In practicing this invention, the average grain diameter and grain size distribution of the silver halide grain to constitute the internal core phase can be varied broadly according to desired photographic characteristics. Regarding the grain size distribution, the distribution is preferred to be as much narrow as possible. To be concrete, the silver halide grains to constitute the internal core phase are desirable to be ones of which 90% by weight have grain sizes in the diameter range of not more than 40% larger and smaller than their average grain diameter, and more preferably not more than 30%.

Namely, the silver halide grains to constitute the internal core phase are desirable to be substantially mono-disperse.

Herein, the term 'the silver halide grains constituting the internal core phase' implies that the weight of the silver halide grains which fall under the range of 20% larger and smaller than the average grain diameter $\bar{r}$ of the silver halide grains to constitute the internal core phase is not less than 60% of the weight of the whole silver halide, and more preferably not less than 70%, and most preferably not less than 80%.

The average grain diameter $\bar{r}$ herein is the same in meaning as the average grain diameter $\bar{r}$ of the foregoing mono-disperse emulsion.

For the preparation of the above monodisperse core emulsion, those double jet methods as disclosed in, e.g., Japanese Patent Examined Publication No. 36890/1973, Japanese Patent Publication Open to Public Inspection (hereinafter referred to as Japanese Patent O.P.I. Publication) Nos. 48520/1979 and 65521/1979 may be used. Besides, those premix methods as described in Japanese Patent O.P.I. Publication No. 158220/1979 and the like may also be used.

The internal core phase is desirable to be one having little lattice defect, which is disclosed in, e.g., U.S. Pat. No. 2,592,250.

An emulsion that is prepared by the conversion method is not suitable as of the internal core phase. Grains prepared with their preparation system's pH and pAg being controlled have little lattice diffect, so that they are preferred as the internal core phase.

The internal core phase can be prepared in the presence of a silver halide solvent. Those thioethers as disclosed in U.S. Pat. No. 3,574,628, those thiourea derivatives as disclosed in Japanese Patent O.P.I. Publication No. 77737/1980, those imidazoles as disclosed in Japanese Patent O.P.I. Publication No. 100717/1979, and the like, may be used. In a preferred embodiment of this invention, the use of ammonia as the silver halide solvent is favorable.

In the silver halide grain of this invention, it is desirable that the external shell phase cover more than 50% of the surface area of the grain constituting the internal core phase.

The external shell phase can contain silver bromide or silver iodide within the range not to adversely affect its photographic characteristics. Part of the external shell can be converted into silver bromide or silver iodide by using a slight amount of a water-soluble bromide or iodide.

The external shell phase is allowed either to cover completely the internal core phase or to cover selectively part of the internal core phase, but preferably should cover more than 50% of the surface area of the grain to constitute the internal core phase, and more preferably should cover completely the whole area of the internal core phase.

For the formation of the external shell phase the fore-going double-jet method or premix method may be used. Also, fine-grained silver halide is mixed into an emulsion containing grains constituting the internal core phase to form the external shell phase by the Ostwald ripening method.

The composition of the silver halide grain to be suitably used in this invention, although not particularly restricted, contains not less than 30 mole % silver chloride in the grain surface, and contains not less than 20 mole % silver chloride as a whole. The use of such grains brings about favorable effects in respect of their latitude to the light-fogging or chemical fogging condition, their preservability at a high temperature and/or high humidity, and the like.

The 'grain surface' herein not only is the outmost surface but also include part in the proximity of the outmost surface. The chloride content of the grain is the amount of silver chloride distributed in the surface and part in the proximity of the surface. The measurement of the surface part including part in the proximity of the outmost surface, particularly the silver halide composition in the range of up to about 20Å in depth below the grain surface can be made according to the ESCA (Electron Spectroscopy for Chemical Analysis) or by the Auger electron spectral analysis method, etc.

In addition, in the present invention, by the outmost shell containing 30 mole % or more silver chloride, the silver chloride content of the grain surface may be equal to this silver chloride content, or the silver chloride content of the outmost shell is continuously varied to become the above silver chloride content in the grain surface.

In practicing this invention, the internal core phase of the silver halide may be any one that is chemically sensitized, doped with metal ions, or subjected to both such treatments, or not subjected at all to both such treatments.

Chemical sensitizers to be used in the chemical sensitization include sulfur sensitizers, gold sensitizers, reduction sensitizers and noble-metal sensitizers, and the sensitization may be carried out also by combining these sensitizers. As the sulfur sensitizer, thiosulfates, thioureas, thiazoles, rhodanines, and other equivalent compounds may be used. Such sensitization methods are described in, e.g., U.S. Pat. Nos. 1,574,944, 1,623,499, 2,410,689, 3,656,955, and the like.

The internal core phase of the silver halide grain to be used in practicing this invention, as is described in, e.g., U.S. Pat. Nos. 2,399,083, 2,597,856 and 2,642,361, may be sensitized by using water-soluble gold compounds, and may also be sensitized by using reduction sensitizers. For such methods, reference can be made to, e.g., U.S. Pat. Nos. 2,487,850, 2,518,698, 2,983,610 and the like.

Further, noble metal compounds such as of platinum, iridium, palladium, etc., may be used to perform noble-metal sensitization. For such the method reference can be made to, e.g., U.S. Pat. Nos. 2,448,060 and British Patent No. 618,061.

The internal core phase of the silver halide grain may be doped with metal ions. In order to dope the internal core phase with metal ions, for example, in any part of the process of forming the grain of the internal core phase, metal ions may be added in the form of a water-soluble salt. Preferred examples of such metal ions include ions of iridium, lead, antimony, bismuth, gold, osmium, rhodium and the like. Any of these metal ions may be used in the concentration range of from $1\times10^{-3}$ to $1\times10^{-4}$ mole per mole of silver.

However, part to be used as the internal core phase of the silver halide grain is allowed to be one not subjected to chemical sensitization treatment or metal ion doping. In this instance, a sensitivity center is considered to be produced due to the formation of crystal deformation in the interface between the internal core phase and the external shell phase in the process of covering the grain of the internal core phase with the external shell phase. For this matter reference can be made to U.S. Pat. Nos. 3,935,014 and 3,957,488.

The silver halide emulsion to be used in this invention may be chemically sensitized in usual manner in any stage of its preparing process. Further, the silver halide grain of this invention may have multivalent metal ions occluded inside the grain. Preferred examples of such multivalent metal ions include ions of iridium, lead, antimony, bismuth, gold, platinum, osmium, rhodium, and the like.

The silver halide grain of this invention is desirable to be such that its grain surface be not chemically sensitized or, even if sensitized, its degree be very slight.

For the direct positive-type silver halide light-sensitive photographic material an internal latent image-type silver halide grains whose surface is not in advance fogged may be used. That the internal latent image-type silver halide grain surface is not in advance fogged herein implies that the density obtained when a test piece prepared by coating such an emulsion on a transparent film support so that its coating weight is 35 $mgAg/cm^2$, without being exposed, is developed for 10 minutes at 20° C. in the following Surface Developer Solution A is 0.6, and more preferably the density does not exceed 0.4.

| Surface Developer Solution A | |
|---|---|
| Metol | 2.5 g |
| 1-Ascorbic acid | 10.0 g |
| $NaBO_2.4H_2O$ | 35.0 g |
| KBr | 1.0 g |
| Water to make 1 liter. | |

The emulsion containing the silver halide grain of this invention is one that gives a sufficient density when a test piece prepared in the above manner, after being exposed, is developed in Internal Developer Solution B having the following composition:

| Internal Developer Solution B | |
|---|---|
| Metol | 2.0 g |
| Anhydrous sodium sulfite | 90.0 g |
| Hydroquinone | 8.0 g |
| Sodium carbonate, monohydrated | 52.5 g |
| KBr | 5.0 g |
| KI | 0.5 g |
| Water to make 1 liter | |

To be more concrete, a part of the foregoing test piece, when exposed on the basis of light intensity scale over a certain period of time up to about 1 second and then developed for 10 minutes in Internal Developer Solution B at 20° C., shows at least 5 times, preferably at least 10 times as much high a maximum density as the maximum density obtained when the other part of the same test piece exposed under the same condition but developed for 10 minutes in Surface Developer Solution A at 20° C.

The silver halide emulsion may be optically sensitized by commonly usable sensitizing dyes. The combination of sensitizing dyes for use in supersensitization of internal latent image-type silver halide emulsions, negative-type silver halide emulsions, etc. is useful also for the silver halide emulsion of this invention. For such sensitizing dyes reference can be made to Research Disclosures Nos. 15162 and 17643.

In the case of obtaining direct positive images from the direct positive-type silver halide light-sensitive photographic material of this invention, the photographic material is subjected to imagewise exposure in usual manner (i.e., photographing; imagewise exposing the light-sensitive material to an object for the formation of its image), and then subjected to surface development, whereby direct positive images can easily be obtained. Namely, the principal process to form a direct positive image comprises imagewise exposing the internal latent image-type silver halide light-sensitive emulsion, then subjecting the emulsion to treatment for producing fog specks chemically or optically (hereinafter called fogging treatment), and after that/or while in the fogging treatment, subjecting the emulsion to surface development. The fogging treatment herein can be made either by subjecting the emulsion to overall exposure or by using a compound for producing fog specks (hereinafter the compound is called a fogging agent).

For example, the overall exposure may be performed in the manner that the imagewise exosed light-sensitive material is immersed into or wetted in a developer solution or other aqueous solution, and then overall, uniformly exposed to light. A light source to be used herein is allowed to be one of any kind as long as it is of a wavelength falling under the wavelength range to which the light-sensitive material is sensitive. Also, the overall exposure is allowed to take place in the manner of short-time exposure by a high-intensity light like an electronic flash light or long-time exposure by a weak light. Time of the overall exposure can be widely varied according to the light-sensitive material, developing conditions and kind of light sources to be used so as to enable to finaly obtain best positive images.

It is most desirable that the overall exposure be given in a certain amount range determined in connection with its combination with the light-sensitive material.

As the fogging agent to be used in this invention, diverse compounds may be used. The fogging agent need only be present at the time of development; for example, the agent may be present in the non-support component layers of the photographic light-sensitive material (above all, in the silver halide emulsion layer is most preferred) or in a developer solution or in a pre-bath solution prior to the developer solution. The using amount of the agent may be varied widely according to the purpose for which it is used; a suitable amount of it to be added, when added to the silver halide emulsion, is from 1 to 1500 mg per mole of silver halide, and preferably from 10 to 1000 mg, and, when added to a processing solution such as a developer solution, is from 0.01 to 5 g/liter, and particularly preferably from 0.05 to 1 g/liter.

Examples of the fogging agent applicable to this invention include those hydrazines as dislcosed in, e.g., U.S. Pat. Nos. 2,563,785 and 2,588,982; those hydrazides or hydrazine compounds as disclosed in U.S. Pat. No. 3,227,552; those heterocyclic quaternary nitrogen salt compounds as disclosed in U.S. Pat. Nos. 3,615,615, 3,718,470, 3,719,494, 3,734,738 and 3,759,901; and compounds having an adsorbing group to the silver halide grain surface like those acylhydrazinophenylthioureas as described in U.S. Pat. No. 4,030,925. These fogging agents may be used in combination. For example, Research Disclosure No. 15162 describes the combined use of a non-adsorbing fogging agent with an adsorbing-type fogging agent.

As the fogging agent to be used in this invention, an either adsorbing-type or non-adsorbing-type fogging agent may be used, or they may be used in combination.

Useful examples of the fogging agent include hydrazine compounds such as hydrazine hydrochloride, phenylhydrazine hydrochloride, 4-methylphenylhydrazine hydrochloride, 1-formyl-2-(4-methylphenyl)hydrazine, 1-acetyl-2-phenylhydrazine, 1-acetyl-2-(4-acetamidophenyl)hydrazine, 1-methylsulfonyl-2-phenylhydrazine, 1-benzolyl-2-phenylhydrazine, 1-methylsulfonyl-2-(3-phenylsulfonamidophenyl)hydrazine, formaldehyde phenylhydrazine, etc.; N-substituted quaternary cycloammonium salts such as 3-(2-formylethyl)-2-methylbenzothiazolium bromide, 3-(2-formylethyl)-2-propylbenzothiazolium bromide, 3-(2-acetylethyl)-2-benzylbenzoselenazolium bromide, 3-(2-acetylethyl)-2-benzyl-5-phenyl-benzoxazolium bromide, 2-methyl-3-[3-(phenylhydrazono)propyl]benzothiazolium bromide, 2-methyl-3-[3-(p-tol-ylhydrazono)-propyl]benzothiazolium bromide, 2-methyl-3-[3-(p-sulfonphenylhydrazono)propyl]benzothiazolium bromide, 2-methyl-3-[3-(p-sulfophenylhydrazono)pentyl]benzothiazolium iodide 1,2-dihydro-3-methyl-4-phenylpyrido[2,1-b]benzothiazolium bromide, 1,2-dihydro-3-methyl-4-phenylpyrido[2,1-b]-5-phenylbenzoxazolium bromide, 4,4'-ethylene-bis(1,2-dihydro-3-methylpyrido[2,1-b]benzothiazolium bromide), 1,2-dihydro-3-methyl-4-phenylpyrido[2,1-b]benzoselenazolium bromide, etc.; and 5-[1-ethylnaphtho(1,2-b)-thiazolin-2-ylideneethylidene]-1-(2-phenyl-carbazolyl)methyl-3-(4-sulfamoylphenyl)-2-thiohydantoin, 5-(3-ethyl-2-benzothiazolinylidene)-3-[4-(2-formylhydrazino)phenyl]-rhodan, 1-[4-(2-formylhydrazino)phenyl]-3-phenylthiourea, 1,3-bis[4-(2-formylhydrazino)phenylthiourea], and the like.

The photographic light-sensitive material of this invention, after being imagewise exposed, is overall exposed or developed in the presence of a fogging agent to thereby form a direct positive image.

For developing the photographic light-sensitive material any arbitrary developing method may be used, but preferably a surface developing method is used. The surface developing method means a method wherein the light-sensitive material is developed in a developer solution which does substantially not contain a silver halide solvent.

Examples of the developing agent applicable to the developer solution for use in developing the photographic light-sensitive material of this invention include common silver halide developing agents such as, for example, polyhydroxybenzenes such as hydroquinone, aminophenols, 3-pyrazolidones, ascorbic acid and its derivatives, reductones, phenylenediamines and mixtures of these compounds; particularly, hydroquinone, aminophenol, N-methylaminophenol, 1-phenyl-3-pyrazolidone, 1-phenyl-4,4-dimethyl-3-pyrazolidone, 1-phenyl-4-methyl-4-hydroxymethyl-3-pyrazolidone, ascorbic acid, N,N-diethyl-p-phenylenediamine, diethylamino-o-toluidine, 4-amino-3-methyl-N-ethyl-N-(β-methansulfonamidoethyl)aniline, 4amino-3-methyl-N-ethyl-N-(β-hydroxyethyl)aniline, and the like. Such the developing agent may be in advance incorporated into an emulsion and, while the emulsion is immersed in a high ph aqueous solution, made react with the silver halide.

The developer solution to be used in this invention may further contain specific antifoggant and development restrainer, or these developer additives may instead be incorporated discretionarily into the component layers of the photographic light-sensitive material. In general, useful antifoggants include benzotriazoles such as 5-methylbenzotriazole, benzimidazoles, benzothiazoles, benzoxazoles, heterocyclic thiones such as 1-phenyl-5-mercaptotetrazole, aromatic and aliphatic mercapto compounds and the like. Also, the developer solution may contain a development restrainer such as a polyalkylene oxide derivative, quaternary ammonium salt compound or the like.

In general, the silver halide light-sensitive photographic material is developed and then fixed in a processing solution containing a silver halide solvent in order to remove disused silver halide, or, in the case of obtaining a color image by development, in order to remove the disused silver halide and metallic silver formed by development, the photographic material is subjected to bleach-fix treatment in a processing solution containing silver halide solvent and oxidation agent. Where, for rapid processing, a light-sensitive material which, after being developed, is adapted to be directly subjected to fixing or bleach-fix treatment without through washing or short stop treatment in an acidic bath is used, the minimum density is restrained to be small, resulting in the obtaining of a good-quality image. To the emulsion containing the silver halide grain of this invention may be discretionarily added various photographic additives.

In the present invention, other additives usable according to purposes include wetting agents such as, e.g., dihydroxylalkanes and the like; layer's physical property improving agents, e.g., aqueous-dispersive particulate high-molecular materials obtained by emulsion polymerization, such as copolymers of alkyl acrylates or alkyl methacrylates with acrylic acid or methacrylic acid, styrene-maleic acid copolymer, styrene-maleic anhydride-half alkyl ester copolymers, etc.; and coating aids such as saponin, polyethylene glycol-lauryl ether, and the like. As further photographic additives, gelatin plasticizers, surface active agents, ultraviolet absorbing agent, pH adjusting agents, antioxidation agents, antistatic agents, viscosity increasing agents, graininess improving agents, dyes, mordants, brightening agents, developing rate control gents, matting agents, and the like may be discretionarily used.

The silver halide emulsion which has been prepared as described above is then coated, if necessary, through subbing layer, antihalation layer and filter layer on a support, whereby an internal latent image-type silver halide light-sensitive photographic material is obtained.

It is useful to use the photographic light-sensitive material of this invention for color photography use. In this case, it is desirable for the light-sensitive material to contain cyan, magenta and yellow dyes-forming couplers in its silver halide emulsion. As the couplers those ordinarily used are applicable.

Also, it is useful to prevent the dye image from becoming brownish due to short-wavelength actinic rays by using a ultraviolet absorbing agent, examples of which include, e.g., thiazolidone, benzotriazole, acrylonitrile, benzophenone-type compounds and the like; particularly, the single or combined use of Tinuvin PS, Tinuvin 320, Tinuvin 326, Tinuving 327 and Tinuvin 328 (all produced by Ciba Geigy) is useful.

As the support of the light-senstive material of this invention, any discretionary material may be used. Typically usable materials for the support include at-need-subbed polyethylene terephthalate film, polycarbonate film, polystyrene film, polypropylene film, cellulose acetate film, glass plates, baryta paper, polyethylene-laminated paper, and the like.

The emulsion containing the silver halide grain of this invention may use, if necessary, an appropriate gelatin derivative in addition to gelatin as its protective colloid or binder. Examples of the appropriate gelatin derivative include, e.g., acylated gelatin, guanidylated gelatin, carbamylated gelatin, cyanoethanolated gelatin, esterified gelatin, and the like.

In the present invention, if necessary, the emulsion may also contain other hydrophilic binder. Appropriate materials, other than gelatin, usable as such the binder include colloidal albunin, agar-agar, gum arabic, dextran, alginic acid, cellulose derivatives such as cellulose acetate hydrolyzed up to 19%-20% acetyl content, polyacrylamide, imidated polyacrylamide, casein, vinyl alcohol polymers containing an urethancarboxylic acid group or cyanoacetyl group such as vinyl alcohol-vinylamino acetate copolymer, polyvinyl alcohol, polyvinyl pyrrolidone, hydrolyzed polyvinyl acetate, polymers obtained by polymerization of protein or saturated acylated protein with a monomer having a vinyl group, polyvinyl pyridine, polyvinylamine, polyaminoethyl methacrylate, polyethyleneamine, and the like. Any of these materials may, if necessary, be added to the component layers of the photographic material such as emulsion layers, intermediate layers, protective layer, filter layers, backing layer, and the like, and besides, to the above hydrophilic binder may, if necessary, be added an appropriate plasticizer, lubricant and the like.

The component layers of the photographic light-sensitive material of this invention may be hardened by an appropriate hardening agent. Examples of the hardening agent include chromium salts; zirconium salts; aldehyde-type and halotriazine-type compounds such as formaldehyde and mucohalogenic acid; polyepoxy compounds; ethyleneimine-type, vinylsulfone-type and acryloyl-type hardening agents; and the like.

The photographic light-senstive material of this invention may have on its support a number of various photographic component layers such as emulsion layers, filter layers, intermediate layers, protective layer, subbing layer, backing layer, antihalation layer, and the like.

EXAMPLE

The present invention will be illustrated further in detail by the following example. It goes without saying that the embodiment of the invention is not limited to and by the exmaple.

Preparation of Emulsions a, b, c, d, e, f, g, h and i

Equimolar amounts of an aqueous silver nitrate solution and an aqueous potassium bromide solution were added simultaneously by the controlled double-jet method, whereby silver bromide cubic grain emulsions having average grain diameters of 0.42 μm (Emulsion a), 0.315 μm (Emulsion b), 0.28 μm (Emulsion c), 0.259 μm (Emulsion d), 0.245 μm (Emulsion e), 0.231 μm (Emulsion f), 0.210 μm (Emulsion g), 0.189 μm (Emulsion h) and 0.175 μm (Emulsion i) were obtained. Differentiation in the grain diameter between these emulsions was made by controlling temperature and adding period of time of the solutions.

Preparation of Emulsions A, B, C, D, E, F, G, H and I

To each of Emulsions a, b, c, d, e, f, g, h and i as core grains were added simultaneously an aqueous silver nitrate solution and a solution of mixture of sodium chloride and potassium bromide (molar ratio of NaCl:KBr=40:60), whereby core/shell-type emulsions A, B, C, D, E, F, G, H and I as shown in Table 1 were obtained. The obtained emulsions were monodisperse emulsions with narrow grain-size distributions.

TABLE 1

| Emulsion | Core grain | Average grain diameter (μm) | AgCl on the* grain surface (mol %) | AgCl of the whole grain (mol %) |
|---|---|---|---|---|
| A | a | 0.60 | 37.3 | 26.3 |
| B | b | 0.45 | 37.1 | 26.3 |
| C | c | 0.40 | 37.0 | 26.3 |
| D | d | 0.37 | 36.8 | 26.3 |
| E | e | 0.35 | 36.5 | 26.3 |
| F | f | 0.33 | 36.3 | 26.3 |
| G | g | 0.30 | 36.1 | 26.3 |
| H | h | 0.27 | 36.0 | 26.3 |

TABLE 1-continued

| Emulsion | Core grain | Average grain diameter (μm) | AgCl on the* grain surface (mol %) | AgCl of the whole grain (mol %) |
|---|---|---|---|---|
| I | i | 0.25 | 35.8 | 26.3 |

*To the extent of 20 Å in depth below the grain surface.

The emulsions given in Table 1 were used, and to them were added sensitizing dyes, couplers, and the like as is described below, whereby multilayered color light-sensitive material samples No. 1 through No. 20 were prepared.

Red-sensitive emulsion layer (Layer 1)

To the emulsions for this layer given in Table 2 were added $3.3\times10^{-7}$ moles of the sensitizing dyes therefor per square meter of the silver halide grain surface area shown in Table 2 to thereby prepare mixtures of emulsions mixed in the ratios as shown in Table 2. To each of these emulsion mixtures were added Surface Active Agent S-2, Stabilizers T-1 and T-2, and a protect-dispersed coupler solution containing dibutyl phthalate, ethyl acetate, 2,5-dioctylhydroquinone, Surface Active Agent S-2 and Cyan Couplers CC-1 and CC-2. Each emulsion, after adding gelatin thereto, was coated so that the coating weight of silver was 0.38 g/m$^2$. In addition, regarding the silver halide emulsion that has been used in the red-sensitive emulsion layer of each of the samples, their respective grain diameter ratios (L/S) of the average grain diameter (L) of the largest average grain size-having silver halide emulsion to the average grain diameter (S) of the smallest average grain size-having silver halide emulsion are shown in Table 2.

First intermediate layer (Layer 2)

A gelatin solution containing a protect-dispersed liquid comprising dioctylphthalate, 2,5-dioctylhydroquinone, ultraviolet absorbing agent Tinuvin 328 (product of Ciba Geigy) and Surface Active Agent S-1 was prepared and then coated so that the coating weight of the Tinuvin 328 was 0.15 g/m$^2$.

Green-sensitive emulsion layer (Layer 3)

To the emulsions for this layer given in Table 2 were added $3.7\times10^{-7}$ moles of the sensitizing dyes therefor per square meter of the silver halide grain surface area shown in Table 2 to thereby prepare mixtures of emulsions mixed in the ratios as shown in Table 2. To each of these emulsion mixtures were added Stabilizers T-1 and T-2, Surface Active Agent S-2, and a protect-dispersed coupler liquid containing dibutyl phthalate, ethyl acetate, 2,5-dioctylhydroquinone, Surface Active Agent S-1 and Magenta Coupler MC-1. These prepared emulsions each, after adding gelatin and Hardening Agent H-1 thereto, was coated so that the coating weight of silver was 0.42 g/m$^2$. In addition, regarding the silver halide emulsion that has been used in the green-sensitive emulsion layer of each of the samples, their respective grain diameter ratios (L/S) of the average grain diameter (L) of the largest average grain size-having silver halide emulsion to the average grain diameter (S) of the smallest average grain size-having silver halide emulsion are shown in Table 2.

Second intermediate layer (Layer 4)

A liquid of the same composition as that of the first intermediate layer was coated so that the coating weight of the Tinuvin 328 was 0.2 g/m$^2$.

Yellow filter layer (Layer 5)

To a yellow colloidal silver prepared by being oxidized in the presence of an alkaline weak reducing agent (after neutralization, the weak reducing agent was removed by noodlewashing method) were added dioctyl phthalate, ethyl acetate, Surface Active Agent S-1, 2,5-octylhydroquinone, Surface Active Agent S-2 and Hardening Agent H-1, and this was coated so that the coating weight of the colloidal silver was 0.15 g/m$^2$.

Third intermediate layer (Layer 6)

The same as the first intermediate layer (Layer 2).

Blue-sensitive emulsion layer (Layer 7)

To the emulsions for this layer given in Table 2 were added $8.0\times10^{-7}$ moles of the sensitizing dyes therefor per square meter of the silver halide grain surface area shown in Table 2 to thereby prepare mixtures of emulsions mixed in the ratios as shown in Table 2. To each of these emulsion mixtures were added Stabilizers T-1 and T-3, Surface Active Agent S-2, and a protect-dispersed coupler liquid containing dibutyl phthalate, ethyl acetate, 2,5-dioctylhydroquinone, Surface Active Agent S-1 and Yellow Coupler y-1. Each of the prepared emulsions, after adding gelatin and Hardening Agent H-1 thereto, was coated so that the coating weight of silver was 0.55 g/m$^2$. In addition, regarding the silver halide emulsion that has been used in the blue-sensitive emulsion layer of each of the samples, their respective grain diameter ratios (L/S) of the average grain diameter (L) of the largest average grain size-having silver halide emulsion to the average grain diameter (S) of the smallest average grain size-having silver halide emulsion are shown in Table 2.

Fourth intermediate layer (Layer 8)

A liquid of the same composition as that of the first intermediate layer was coated so that the coating weight of the Tinuvin 328 was 0.35 g/m$^2$.

Protective layer (Layer 9)

A gelatin solution containing colloidal silica, Coating Aid S-2 and Hardening Agents H-2 and H-3 was coated so that the coating weight of the gelatin was 1.0 g/m$^2$.

The above 9 layers, Layer 1 through Layer 9, were coated simultaneously on a surface-treated polyethylene-laminated paper support.

These prepared samples were allowed to stand for three days under the atmospheric condition of a temperature of 40° C. with a relative fumidity of 80%.

Stabilizers:

Stabilizers:

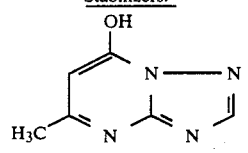

T-1

-continued
T-2
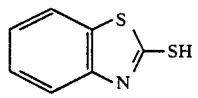
T-3
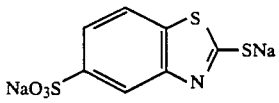
Surface Active Agents:
S-1
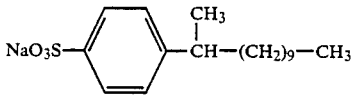
S-2
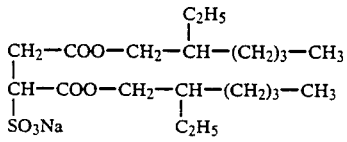
Hardening Agents:
H-1
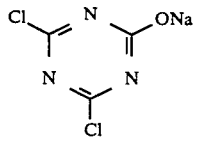
H-2
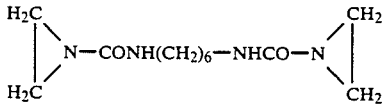
H-3
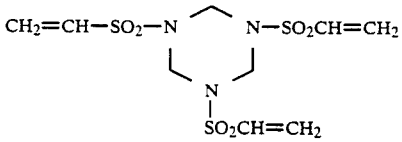
Yellow Coupler:
YC-1
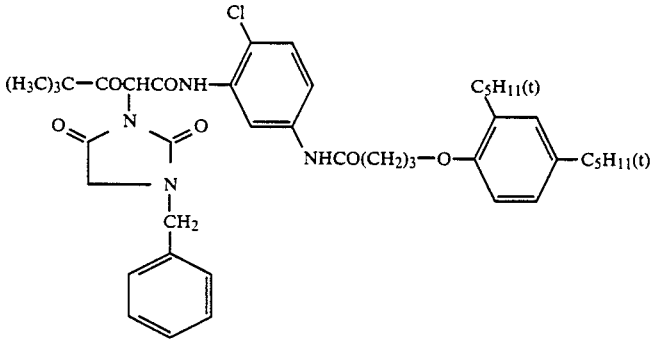
Magenta Coupler:

-continued

MC-1

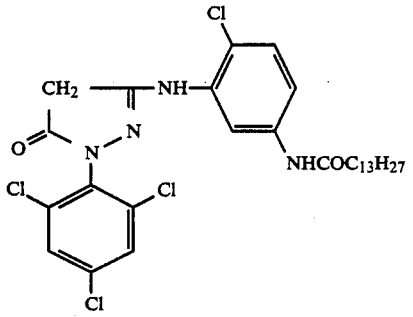

Cyan Couplers:

CC-1

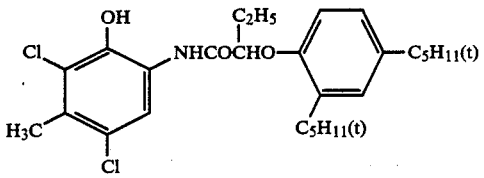

CC-2

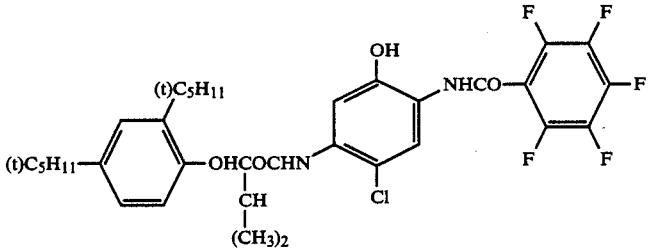

These light-sensitive material Samples No. 1 through No. 14 each was exposed for 0.5 second through an optical wedge to a white light at a color temperature of 2854° K. After the exposure, each exposed sample was subjected to the following photographic processing.

In the following processing procedure steps, the fogging exposure in Step [2] took place with illuminance being varied as 0.125 lux, 0.177 lux, 0.250 lux, 0.354 lux, 0.500 lux, 0.707 lux, 1.000 lux, 1.414 luces, 2.000 luces, 2.828 luces, 4.000 luces, 5.66 luces, 8.00 luces, 11.30 luces and 16.00 luces.

| Processing Steps | Temperature | Time |
|---|---|---|
| [1] Immersion (in color developer solution) | 38° C. | 8 seconds |
| [2] Fogging exposure | — | 10 seconds |
| [3] Color developing | 38° C. | 2 minutes |
| [4] Bleach-fix | 35° C. | 60 seconds |
| [5] Stabilizing | 25 to 30° C. | 1 minute and 30 seconds |
| [6] Drying | 75 to 80° C. | 1 minute |

Compositions of the processing solutions:

| (Color Developer Solution) | |
|---|---|
| Benzyl alcohol | 10 ml |
| Ethylene glycol | 15 ml |
| Potassium sulfite | 2.0 g |
| Potassium bromide | 1.5 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-Methyl-4-amino-N-ethyl-N-(β-methanesulfonamidoethyl)-aniline sulfate | 5.5 g |

-continued

| | |
|---|---|
| Brightening agent (4,4'-diaminostilbenesulfonic acid derivative) | 1.0 g |
| Potassium hydroxide | 2.0 g |
| Water to make 1 liter. | |
| Adjust the pH to 10.20. | |

| (Bleach-Fix Bath Solution) | |
|---|---|
| Ferric-ammonium ethylenediaminetetra-acetate, dihydrated | 60 g |
| Ethylenediaminetetraacetic acid | 3 g |
| Ammonium thiosulfate (70% solution) | 100 ml |
| Ammonium sulfite (40% solution) | 27.5 ml |
| Add potassium carbonate or glacial acetic acid to adjust the pH to 7.1, and then add water to make 1 liter. | |

| (Stabilizing Solution) | |
|---|---|
| 5-Chloro-2-methyl-4-isothiazoline-3-one | 1.0 g |
| Ethylene glycol | 10 g |
| 1-Hydroxyethylidene-1,1'-diphosphonic acid | 2.5 g |
| Bismuth chloride | 0.2 g |
| Magnesium chloride | 0.1 g |
| Ammonium hydroxide (28% solution) | 2.0 g |
| Sodium nitrilotriacetate | 1.0 g |
| Water to make 1 liter. Adjust the pH to 7.0 by use of ammonium hydroxide or sulfuric acid. | |

In addition, the stabilizing process was performed in a double-bath counterflow system.

Comparative Sensitizing Dyes:

D-1

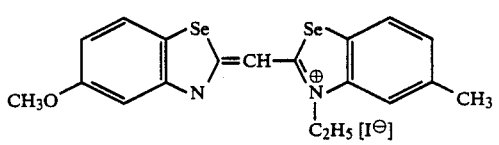

-continued

D-2

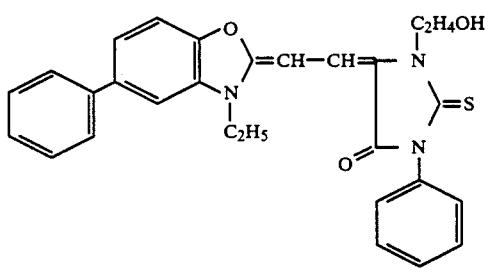

D-3

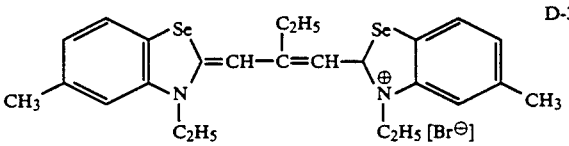

After the processing, each sample was measured with respect to its reflection densities by blue, green and red lights.

In addition, the fogging exposure latitude is defined as follows:

When each sample was exposed to light with the illuminance for fogging being varied, if the maximum density is not less than 1.6 in a fogging illuminance of not less than $L_1$ and if the minimum density is not more than 0.2 in a fogging illuminance of not more than $L_2$, then the fogging exposure latitude is:

$$\log \frac{L_2}{L_1}.$$

This means that the larger the fogging exposure latitude value, the wider the fogging exposure latitude of the light-sensitive material and the harder is the light-sensitive material to be affected by changes in the characteristics of the light source and fluctuation in the characteristics of the processing solution, thus enabling the light-sensitive material to be processed more stably.

As for the gamma value, in a characteristic curve that is obtained by subjecting the light-sensitive material to fogging exposure at 1.00 lux, the inclination of the line connecting the 20% density point of the maximum density with the 80% density point of the maximum density is expressed as Gamma I, while the inclination of the line connecting the point of a density of 0.5 and the point of a density of 0.2 is expressed as Gamma II.

Herein, from Gamma I the gradation and exposure latitude of the light-sensitive material can be evaluated; the lower the gamma value, the softer the gradation and the wider the exposure latitude of the light-sensitive material.

From Gamma II the gradation, particularly in the high-light area, of a photographic image can be evaluated; in its value, around 1.0 is preferred.

The results obtained by measuring the fogging exposure latitude, the maximum density (Dmax), the minimum density (Dmin) and gamma value of each sample are as given in Table 2, provided that the maximum density (Dmax) and the minimum density (Dmin) are of the values ohtained when the fogging exposure was made at an illuminance of 1.00 lux.

TABLE 2

| Sample No. | Emulsions used: Blue-sensitive layer | Emulsions used: Green-sensitive layer | Emulsions used: Red-sensitive layer | Grain diameter ratio (L/S): Blue-sensitive layer | Grain diameter ratio (L/S): Green-sensitive layer | Grain diameter ratio (L/S): Red sensitive layer | EM mixing ratio*: Blue-sensitive layer | EM mixing ratio*: Green-sensitive layer | EM mixing ratio*: Red-sensitive layer | Sensitizing dyes: Blue-sensitive layer | Sensitizing dyes: Green-sensitive layer | Sensitizing dyes: Red-sensitive layer |
|---|---|---|---|---|---|---|---|---|---|---|---|---|
| Com. 1 | A, F | B, I | B, I | 1.82 | 1.80 | 1.80 | 60% | 50% | 50% | I-1 | II-10 | III-6 |
| Com. 2 | A, F | B, I | B, I | 1.82 | 1.80 | 1.80 | 60% | 50% | 50% | D-1 | D-2 | D-3 |
| Com. 3 | A, F | B, I | B, I | 1.82 | 1.80 | 1.80 | 52% | 42% | 42% | I-1 | II-10 | III-6 |
| Com. 4 | A, F | B, I | B, I | 1.82 | 1.80 | 1.80 | 52% | 42% | 42% | D-1 | D-2 | D-3 |
| Inv. 5 | A, F | B, I | B, I | 1.82 | 1.80 | 1.80 | 50% | 40% | 40% | I-1 | II-10 | III-6 |
| Com. 6 | A, F | B, I | B, I | 1.82 | 1.80 | 1.80 | 50% | 40% | 40% | D-1 | D-2 | D-3 |
| Inv. 7 | A, F | B, I | B, I | 1.82 | 1.80 | 1.80 | 45% | 30% | 25% | I-1 | II-10 | III-6 |
| Com. 8 | A, F | B, I | B, I | 1.82 | 1.80 | 1.80 | 45% | 30% | 25% | D-1 | D-2 | D-3 |
| Inv. 9 | A, F | B, I | B, I | 1.82 | 1.80 | 1.80 | 40% | 25% | 20% | I-1 | II-10 | III-6 |
| Com. 10 | A, F | B, I | B, I | 1.82 | 1.80 | 1.80 | 40% | 25% | 20% | D-1 | D-2 | D-3 |
| Inv. 11 | A, F | B, I | B, I | 1.82 | 1.80 | 1.80 | 25% | 15% | 10% | I-1 | II-10 | III-6 |
| Com. 12 | A, F | B, I | B, I | 1.82 | 1.80 | 1.80 | 25% | 15% | 10% | D-1 | D-2 | D-3 |
| Inv. 13 | A, F | B, I | B, I | 1.82 | 1.80 | 1.80 | 10% | 8% | 5% | I-1 | II-10 | III-6 |
| Com. 14 | A, F | B, I | B, I | 1.82 | 1.80 | 1.80 | 10% | 8% | 5% | D-1 | D-2 | D-3 |
| Inv. 15 | A, F | B, I | B, I | 1.82 | 1.80 | 1.80 | 8% | 6% | 4% | I-1 | II-10 | III-6 |
| Com. 16 | A, F | B, I | B, I | 1.82 | 1.80 | 1.80 | 8% | 6% | 4% | D-1 | D-2 | D-3 |
| Com. 17 | A, B | B, E | B, E | 1.33 | 1.29 | 1.29 | 25% | 15% | 10% | I-1 | II-10 | III-6 |
| Com. 18 | A, C | B, G | B, G | 1.50 | 1.50 | 1.50 | 25% | 15% | 10% | I-1 | II-10 | III-6 |
| Inv. 19 | A, D | B, H | B, H | 1.62 | 1.67 | 1.67 | 25% | 15% | 10% | I-1 | II-10 | III-6 |
| Inv. 20 | A, C, F | B, G, I | B, G, I | 1.82 | 1.80 | 1.80 | 25% | 15% | 10% | I-1 | II-10 | III-6 |

| Sample No. | Maximum density (D max): Blue-sensitive layer | Maximum density (D max): Green-sensitive layer | Maximum density (D max): Red-sensitive layer | Minimum density (D min): Blue-sensitive layer | Minimum density (D min): Green-sensitive layer | Minimum density (D min): Red-sensitive layer | Fogging exposure latitude: Blue-sensitive layer | Fogging exposure latitude: Green-sensitive layer | Fogging exposure latitude: Red-sensitive layer |
|---|---|---|---|---|---|---|---|---|---|
| Com. 1 | 2.25 | 2.30 | 2.32 | 0.10 | 0.09 | 0.07 | 0.48 | 0.51 | 0.52 |
| Com. 2 | 1.85 | 1.89 | 1.98 | 0.14 | 0.14 | 0.12 | 0.32 | 0.37 | 0.39 |
| Com. 3 | 2.24 | 2.29 | 2.30 | 0.10 | 0.08 | 0.07 | 0.48 | 0.50 | 0.52 |
| Com. 4 | 1.83 | 1.87 | 1.97 | 0.14 | 0.13 | 0.12 | 0.30 | 0.33 | 0.37 |
| Inv. 5 | 2.24 | 2.29 | 2.30 | 0.10 | 0.08 | 0.07 | 0.48 | 0.50 | 0.52 |

TABLE 2-continued

| | | | | | | | | | |
|---|---|---|---|---|---|---|---|---|---|
| Com. 6 | 1.83 | 1.87 | 1.97 | 0.14 | 0.13 | 0.12 | 0.30 | 0.33 | 0.37 |
| Inv. 7 | 2.23 | 2.27 | 2.27 | 0.09 | 0.08 | 0.07 | 0.48 | 0.49 | 0.51 |
| Com. 8 | 1.81 | 1.85 | 1.94 | 0.14 | 0.13 | 0.12 | 0.30 | 0.33 | 0.35 |
| Inv. 9 | 2.22 | 2.26 | 2.26 | 0.08 | 0.07 | 0.07 | 0.48 | 0.49 | 0.50 |
| Com. 10 | 1.76 | 1.80 | 1.90 | 0.14 | 0.13 | 0.12 | 0.29 | 0.32 | 0.35 |
| Inv. 11 | 2.20 | 2.25 | 2.25 | 0.08 | 0.07 | 0.07 | 0.48 | 0.49 | 0.50 |
| Com. 12 | 1.72 | 1.75 | 1.85 | 0.14 | 0.13 | 0.12 | 0.29 | 0.32 | 0.35 |
| Inv. 13 | 2.18 | 2.23 | 2.23 | 0.08 | 0.07 | 0.07 | 0.48 | 0.49 | 0.50 |
| Com. 14 | 1.68 | 1.71 | 1.80 | 0.14 | 0.13 | 0.12 | 0.29 | 0.31 | 0.35 |
| Inv. 15 | 2.18 | 2.22 | 2.22 | 0.08 | 0.07 | 0.07 | 0.48 | 0.49 | 0.50 |
| Com. 16 | 1.67 | 1.70 | 1.78 | 0.14 | 0.13 | 0.12 | 0.29 | 0.31 | 0.35 |
| Com. 17 | 2.12 | 2.16 | 2.16 | 0.08 | 0.07 | 0.07 | 0.51 | 0.52 | 0.53 |
| Com. 18 | 2.17 | 2.20 | 2.21 | 0.08 | 0.07 | 0.07 | 0.51 | 0.52 | 0.53 |
| Inv. 19 | 2.18 | 2.23 | 2.23 | 0.08 | 0.07 | 0.07 | 0.49 | 0.50 | 0.52 |
| Inv. 20 | 2.22 | 2.26 | 2.27 | 0.08 | 0.07 | 0.07 | 0.48 | 0.49 | 0.50 |

| | Gamma value | | | | | |
|---|---|---|---|---|---|---|
| | Gamma I** | | | Gamma II*** | | |
| Sample No. | Blue-sensitive layer | Green-sensitive layer | Red-sensitive layer | Blue-sensitive layer | Green-sensitive layer | Red-sensitive layer |
| Com. 1 | 2.08 | 2.15 | 2.20 | 1.22 | 1.32 | 1.69 |
| Com. 2 | 2.09 | 2.18 | 2.22 | 1.20 | 1.31 | 1.72 |
| Com. 3 | 1.69 | 1.75 | 1.79 | 1.17 | 1.20 | 1.37 |
| Com. 4 | 1.70 | 1.77 | 1.81 | 1.14 | 1.18 | 1.39 |
| Inv. 5 | 1.40 | 1.42 | 1.43 | 1.03 | 1.05 | 1.09 |
| Com. 6 | 1.52 | 1.58 | 1.60 | 1.09 | 1.16 | 1.33 |
| Inv. 7 | 1.32 | 1.35 | 1.35 | 1.00 | 1.03 | 1.05 |
| Com. 8 | 1.47 | 1.52 | 1.55 | 1.08 | 1.15 | 1.32 |
| Inv. 9 | 1.27 | 1.31 | 1.31 | 0.99 | 1.00 | 1.02 |
| Com. 10 | 1.43 | 1.48 | 1.50 | 1.06 | 1.15 | 1.30 |
| Inv. 11 | 1.20 | 1.21 | 1.21 | 0.97 | 0.98 | 1.01 |
| Com. 12 | 1.40 | 1.44 | 1.45 | 1.05 | 1.13 | 1.28 |
| Inv. 13 | 1.22 | 1.24 | 1.24 | 0.95 | 0.96 | 0.98 |
| Com. 14 | 1.40 | 1.45 | 1.48 | 1.00 | 1.10 | 1.25 |
| Inv. 15 | 1.25 | 1.27 | 1.28 | 0.93 | 0.94 | 0.95 |
| Com. 16 | 1.44 | 1.48 | 1.53 | 0.93 | 1.05 | 1.20 |
| Com. 17 | 2.08 | 2.10 | 2.12 | 1.20 | 1.33 | 1.78 |
| Com. 18 | 1.65 | 1.67 | 1.67 | 1.18 | 1.30 | 1.65 |
| Inv. 19 | 1.34 | 1.32 | 1.31 | 1.05 | 1.07 | 1.09 |
| Inv. 20 | 1.18 | 1.20 | 1.19 | 0.95 | 0.96 | 0.98 |

Note:
*The mixing ratio by weight of the smallest average grain diameter-having silver halide grains.
'Inv.': Invention sample.
'Com.': Comparative sample.
**Gamma I: Inclination of the straight line connecting the 20% density point with the 80% density point of the maximum density.
***Gamma II: Inclination of the straight line connecting the points of a density of 0.5 and a density of 0.2.

As is apparent from the results shown in Table 2, each of the invention's Samples No. 5, No. 7, No. 9, No. 11, No. 13, No. 15, No. 19 and No. 20 shows a high-quality image having high maximum density and low minimum density, and its fogging exposure latitude is wide enough to be processed stably against changes in the characteristics of light sources for fogging, flucturations in the characteristics of the developer solution, and the like. The gamma-I value of each of the samples is low enough to show a soft gradation and a wide exposure latitude, and its gamma-II value is close to 1.0. Moreover, the fogging exposure latitudes of the three layers, blue-sensitive, green-sensitive and red-sensitive layers, and their gamma values are well balanced to keep their characteristics satisfactory.

In contrast, each of Comparative Samples No. 2, No. 4, No. 6, No. 8, No. 10, No. 12, No. 14 and No. 16, except No. 1, No. 3, No. 17 and No. 18, has low maximum density and high minimum density, so that as a good quality image as in the samples for this invention cannot be obtained. Comparative Samples No. 1 through No. 4 and No. 17 and No. 18 each has a very high gamma value, and the balance of gamma II of the three layers is not good, either, and even Samples No. 6, No. 8, No. 10, No. 12 and No. 14 each is unable to show as soft gradation as seen in the samples for this invention, and has a narrow exposure latitude, thus being inferior in the characteristics. In the fogging exposiure latitude, comparative samples excluding No. 1, No. 3, No. 17 and No. 18 are inferior in respect that they are liable to be affected by changes in the characteristics of light sources, fluctuations in the developer solution's characteristics, and the like.

What is claimed is:

1. A direct positive type silver halide photographic light-sensitive material comprising a support having thereon at least one blue-sensitive silver halide emulsion layer, at least one green-sensitive silver halide emulsion layer and at least one red-sensitive silver halide emulsion layer, which, after being imagewise exposed, are to directly form a positive image by being light-fogged while in developing or by developing in the presence of a fogging agent, wherein each of said silver halide emulsion layers are comprised of at least two silver halide emulsions being different in average silver halide grain size, and in each of said emulsion layers, average diameter S of silver halide grains of the emulsion having the smallest average grain size and the average diameter L of silver halide grains of the emulsion having the largest average grain size have a proportional relation of $1.6 \leqq L/S$; and the ratio by weight of silver halide grains of the emulsion having the smallest average grain size in each silver halide emulsion layer to the whole silver halide grains contained in each silver halide emulsion layer is within the range of from 2% to 50% in said blue-sensitive emulsion layer, from 2% to 40% in said green-sensitive and red-sensitive emulsion layers; and said blue-sensitive emulsion layer contains at least one sensitizing dye represented by the following Formula I, said green-sensitive emulsion layer contains at least one sensitizing dye represented by the following Formula II and said red-sensitive emulsion layer contains at least one sensitizing dye represented by the following Formula III, Formula I

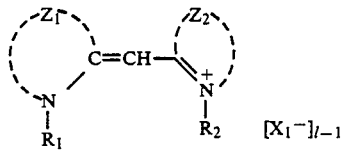

wherein $Z_1$ and $Z_2$ each represents a group of atoms necessary to complete a ring of benzothiazole, naphthothiazole, benzoselenazole or naphthoselenazole; $R_1$ and $R_2$ each represents an unsubstituted or substituted alkyl group, provided that at least one of the $R_1$ and $R_2$ represents an alkyl group substituted by a sulfo group or a carboxyl group; $X_1^-$ respresents an anion;

and l represents an integer of 1 or 2,

Formula II

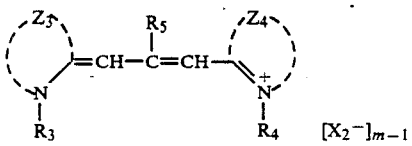

wherein $Z_3$ and $Z_4$ each represents a group of atoms necessary to complete a ring of benzoxazol or naphthoxazole; $R_3$ and $R_4$ each represents an unsubstituted or substituted alkyl group, provided that at least one of the $R_3$ and $R_4$ represents an alkyl group substituted by a sulfo group or a carboxyl group; $R_5$ represents a lower alkyl group; $X_2^-$ represents an anion; and m represets an integer of 1 or 2, Formula III

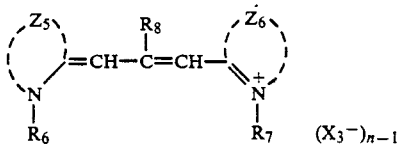

wherein $Z_5$ and $Z_6$ each represents a group of atoms necessary to complete a ring of benzothiazole, naphthothiazole, benzoselenazole, or naphthoselenazole; $R_6$ and $R_7$ each represents an unsubstituted or substituted alkyl group, provided that at least one of the $R_6$ and $R_7$ represents an alkyl group substituted by a sulfo group or a carboxyl group; $R_8$ represents an alkyl group or an aryl group; $X_3^-$ represents an anion; and n represents an integer of 1 or 2.

2. The material of claim 1, wherein said proportional relation is $1.6 \leqq L/S \leqq 2.3$.

3. The material of claim 1, wherein said ratio of said silver halide grains of said silver halide emulsion having the smallest average grain size in said blue-sensitive emulsion layer is within the range of from 2% to 40%.

4. The material of claim 3 wherein said ratio is within the range of 10 to 40 percent.

5. The material of claim 1, wherein said ratio of said silver halide grains of said silver halide emulsion having the smallest average grain size in said green-sensitive emulsion layer is within the range of from 2% to 25%.

6. The material of claim 5, wherein said ratio is within the range of from 8% to 25%.

7. The material of claim 1, wherein said ratio of said silver halide grains of said silver halide emulsion having the smallest average grain size in said red-sensitive emulsion layer is within the range of from 2% to 20%.

8. The material of claim 7, wherein said ratio is within the range of from 5% to 20%.

9. The material of claim 1, wherein said blue-sensitive emulsion layer contains at least one silver halide emulsion containing said sensitizing dye represented by Formula I in an amount of not less than $5.5 \times 10^{-7}$ mole per square meter of surface area of silver halide grains.

10. The material of claim 9, wherein said amount of said sensitizing dye is within the range of from $5.5 \times 10^{-7}$ mol to $15 \times 10^{-7}$ mol per square meter of surface area of silver halide grains.

11. The material of claim 10, wherein said amount of said sensitizing dye is within the range of from $6.5 \times 10^{-7}$ mol to $11.0 \times 10^{-7}$ mol per square meter of surface area of silver halide grains.

12. The material of claim 1, wherein said green-sensitive emulsion layer contains at least one emulsion containing said sensitizing dye represented by Formula II in an amount of ont less than $2.0 \times 10^{-7}$ mol per square meter of surface area of silver halide grains.

13. The material of claim 12, wherein said amount of said sensitizing dye is within the range of from $2.0 \times 10^{-7}$ mol to $8.0 \times 10^{-7}$ mol per square meter of surface area of silver halide grains.

14. The material of claim 13, wherein said amount of said sensitizing dye is within the range of from $2.5 \times 10^{-7}$ mol to $5.0 \times 10^{-7}$ mol per square meter of surface area of silver halide grains.

15. The material of claim 1, wherein said red-sensitive emulsion layer contains at least one silver halide emulsion containing said sensitizing dye represented by Formula III in an amount of ont less than $1.5 \times 10^{-7}$ mol per square meter of surface area of silver halide grains.

16. The material of claim 15, wherein said amount of said sensitizing dye is $1.5 \times 10^{-7}$ mol to $7.5 \times 10^{-7}$ mol per square meter of surface area of silver halide grains.

17. The material of claim 16, wherein said amount of said sensitizing dye is within the range of from $2.0 \times 10^{-7}$ mol to $4.5 \times 10^{-7}$ mol per square meter of surface area of silver halide grains.

18. The material of claim 1, wherein each of said emulsions is a monodispersed emulsion in which silver halide grains having a diameter within the range of ±20% of the average grain diameter are contained in an amount of not less than 60% of the weight of whole silver halide.

19. The material of claim 18, wherein said amount is not less than 70%.

20. The material of claim 19, wherein said amount is not less than 80%.

21. The material of claim 1, wherein said said emulsions each comprises silver halide grains comprised of at least two strata including an internal core stratum and an external shell stratum, different from each other in the silver halide composition.

22. The material of claim 21, wherein said silver halide grains have a silver chloride content of not less than 30 mol % in the grain surface and not less than 20 mol % as a whole.

* * * * *